US006183525B1

(12) United States Patent
Jones

(10) Patent No.: US 6,183,525 B1
(45) **Date of Patent: *Feb. 6, 2001**

(54) FUEL ADDITIVE COMPOSITION AND METHOD FOR THE TREATMENT OF FUELS

(75) Inventor: Edward T. Jones, Sturgeon Bay, WI (US)

(73) Assignee: American Energy Group, Inc., Milwaukee, WI (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/156,420

(22) Filed: Sep. 18, 1998

(51) Int. Cl.[7] ..... C10L 1/18
(52) U.S. Cl. ..... 44/443; 44/447; 44/450
(58) Field of Search ..... 44/447, 450, 443

(56) References Cited

U.S. PATENT DOCUMENTS 2,089,580 * 8/1937 Schulze ..... 44/400
4,439,343 * 3/1984 Albanese ..... 252/305
4,483,783 * 11/1984 Albanese ..... 252/312

* cited by examiner

*Primary Examiner*—D. Gabrielle Brouillette
*Assistant Examiner*—Cephia D. Toomer
(74) *Attorney, Agent, or Firm*—Rockey, Milnamow & Katz, Ltd.

(57) ABSTRACT

A fuel additive for use in the treatment of liquid hydrocarbon fuels to reduce polluting emissions during the combustion of such fuels wherein the additive composition is formulated to contain mineral seal oil, mineral spirits, a glycol alkyl ether and at least one alkyl aromatic ethoxylated surfactant. It has been found that the fuel additive composition of the invention can be blended with such fuels to dramatically reduce emissions during the combustion of such fuels.

18 Claims, No Drawings

FUEL ADDITIVE COMPOSITION AND METHOD FOR THE TREATMENT OF FUELS

This invention is addressed to the treatment of fuels, and more particularly to the treatment of fossil fuels such as gasoline fuel to render such fuels cleaner burning in the control of emissions.

BACKGROUND OF THE INVENTION

The control of emissions from internal combustion engines has received substantially continuous attention for many years in attempts to reduce emissions of carbon monoxide and unburned hydrocarbons from the combustion of such fuels. The control of pollution has received worldwide attention as attempts are made to fashion fuel additives that have the capability of making such liquid hydrocarbon fuels cleaner burning. Various approaches have been taken in the prior art in attempts to formulate additives that reduce the pollution generated by such fuels, but generally have met with limited success.

For example, it has been proposed to employ various alkyl ethers for the purpose of controlling pollution generated by gasoline fuels. Such attempts are described in U.S. Pat. Nos. 2,089,580, 2,104,021, 2,221,839, 2,563,101, 2,786,745, 2,930,681, 3,032,971, 3,103,101, 3,270,497, and 5,425,790, as representative. As described in those patents, it is frequently the practice to employ such ethers either alone or in combination with alcohol to provide improved performance characteristics in a variety of liquid hydrocarbon fuels.

Attempts have likewise been made to clean up such fuels by incorporating in the fuel as an additive various aromatic detergents containing one or more aromatic rings and bonded thereto various alkylene oxide groups in an effort to reduce hydrocarbon emissions. Such an approach is described in U.S. Pat. Nos. 3,328,284 and 3,615,295. The prior art has likewise proposed various combinations of additives to clean fuel systems. One such example is U.S. Pat. No. 3,658,494, describing a combination of oxy compounds in the form of monoethers of glycols and polyglycols in combination with dispersants derived from high molecular weight carboxylic acids, and particularly their esters, amides, imides, amidines and amine salts. U.S. Pat. No. 4,384,872 describes a fuel additive formulated of a lower alkanol combination with a surfactant to provide increased water tolerance in such fuel compositions. Similar approaches are described in U.S. Pat. No. 4,516,981, teaching an oil sludge dispersant formulated of an alcohol, a glycol ether and a poly ethoxylated phenol. And U.S. Pat. No. 4,877,416 teaching a combination of a hydrocarbon substituted amine or polyamine and a poly (oxy alkylene) monool.

Attempts have also been made to use oxidizing agents in combination with glycols and glycol ethers. One such example is described in U.S. Pat. No. 5,314,511, describing the combination of an organic peroxide in combination with a lower alkylene glycol ether to reduce emissions. U.S. Pat. No. 5,409,507 describes a fuel additive which is formulated of a nitro, amino or N-alkylamino-substituted poly (oxyalkylene) aromatic ethers in combination with antioxidants, metal deactivators, demulsifiers and like known additives. U.S. Pat. No. 5,782,936 describes a fuel additive for liquified petroleum gases or LPG containing a petroleum fraction methanol and an ethoxylated alkyl phenol.

Notwithstanding all of the efforts in the area of improving the performance of such fuels from a standpoint of pollution control, no product has been, up to the present, capable of satisfying rigorous pollution standard presently in effect or contemplated. Thus, there is a need to provide a fuel additive composition which has the capability of significantly reducing pollution from such liquified hydrocarbon fuels.

It is accordingly an object of the present invention to provide a fuel additive composition which overcomes the foregoing disadvantage.

It is another object of the invention to provide a method for the treatment of liquid hydrocarbon fuels which has the capability of significantly lowering the pollution characteristics of such fuels when used in internal combustion engines.

It is a more specific object of the present invention to provide a fuel additive composition which can be added to liquid hydrocarbon fuels to promote cleaner, more efficient combustion thereof in internal combustion engines.

It is another related object of the invention to provide a method for the treatment of liquid hydrocarbon fuels with a fuel additive composition whereby the pollution emitted by the treated fuel is substantially reduced.

These and other objects and advantages of the invention will appear more fully hereinafter by way of the following description of the invention.

SUMMARY OF THE INVENTION

The concepts of the present invention reside in a novel fuel additive composition which is not only simple and inexpensive to manufacture, but also has the capability of enhancing the performance characteristics of liquid hydrocarbon fuels such that the treated fuels, when consumed in an internal combustion engine, burn far more efficiently with substantially less emissions. In accordance with the concepts of the invention, the fuel additive composition is formulated with a novel combination of components which function together to significantly reduce hydrocarbon emissions in the burning of fuel to which the additive has been combined in internal combustion engines.

The fuel additive composition of the present invention is formulated to contain mineral seal oil, mineral spirits, an ethylene glycol monoalkyl ether and at least one ethoxylated long chain phenol as a surfactant. The precise manner in which the foregoing components function in combination with each other is not fully understood at the present time. Without limiting the invention as to theory, however, it is believed that the mineral seal oil serves to provide upper cylinder lubrication as part of the combustion process. The mineral spirits appear to promote rapid oxidation of the hydrocarbon fuel with which the additive is combined and the glycol ether in combination with the surfactant appears to disperse water contained within the fuel system containing the additive so as not to interfere with the complete combustion of the treated fuel. Tests have shown that gasoline which has been treated with the fuel additive in the present invention can virtually immediately cause internal combustion engines to meet, and sometimes exceed, current pollution standards even with an internal combustion engine which is poorly tuned.

In accordance with another concept of the invention, the present invention is also directed to a method of treatment of liquid hydrocarbon fuels with the fuel additive. In accordance with the method of the invention, the fuel additive composition is added to a liquid hydrocarbon fuel, which can then be burned in an internal combustion engine. The treatment of he liquid hydrocarbon fuel with the fuel additive composition has been found to dramatically decrease the emissions given off during combustion in gasoline engines.

DETAILED DESCRIPTION OF THE INVENTION

The fuel additive composition of the present invention is formulated to include, as one component thereof, mineral seal oil. The term "mineral seal oil" as used herein is well understood by those skilled in the art as referring to well-known lubricating oils, mineral oils and high boiling petroleum distillates having a boiling point above 250° C., and preferably within the range of 270° C. to 370° C. Such oils are well known to those skilled in the art, and are described in detail in U.S. Pat. No. 4,443,348, the disclosure of which is incorporated herein by reference. As indicated above and without limiting the invention as to theory, it is believed that the mineral seal oil serves to provide upper cylinder lubrication when a fuel containing the fuel additive composition of the present invention is consumed in an internal combustion engine.

Another component employed in the formulation of the fuel additive composition of the present invention is referred to as mineral spirits, another well understood term as described in U.S. Pat. No. 4,443,348. The term "mineral spirits" covers low boiling petroleum fractions boiling at a temperature of at least 150° C. and preferably a temperature within the range of about 150° C. to about 220° C. Again, without limiting the invention as to theory, it is believed that the mineral spirits component of the fuel treatment composition of the present invention serves at least in part to control the combustion of the fuel with which the additive is combined.

Another component used in the practice of the present invention is an ethylene glycol monoalkyl ether. Preferred for use in the practice of the present invention are those ethers having the following structural formula:

$$HO—CH_2—CH_2—O—R_1$$

wherein $R_1$ is an alkyl group containing 3 to 6 carbon atoms (e.g., propyl, butyl, isobutyl, pentyl and hexyl groups). The preferred ether employed in the practice of the present invention is ethylene glycol monobutyl ether.

The fuel additive composition of the present invention is likewise formulated to include at least one alkyl aromatic ethoxylated surfactant. Again, without limiting the invention as to theory, it is believed that the surfactant and the ether cooperate each with the other to minimize the effects of water contained in the fuel during the combustion process. In the preferred practice of the present invention, the surfactant is at least one compound having the formula:

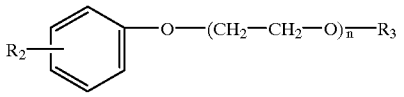

wherein $R_2$ is a long chain alkyl group, and preferably one containing 6 to 12 carbon atoms (e.g., heptyl, octyl, nonyl, decyl, etc.). $R_3$ is selected from the group consisting of hydrogen and lower alkyl (e.g., methyl, ethyl, propyl) and n is an integer ranging from 2 to 12. It is frequently preferred, in the practice of the present invention, to use combinations of the foregoing surfactants. For example, it is possible and sometimes desirable to employ an ethoxylate wherein $R_3$ is lower alkyl and/or an ethoxylated compound where $R_3$ is hydrogen. Such surfactants are commercially available under the trademark TERGITOL. For example, TERGITOL NP-4 is a nonyl phenol polyethoxylate while TERGITOL NP-9 is a nonyl phenol polyethylene glycol ether. It has been found that particularly effective results are achieved in reducing hydrocarbon emissions when TERGITOL NP-4 and TERGITOL NP-9 are used in combination with each other.

The fuel additive composition of the present invention can also be formulated with other components which do not materially effect the composition. For example, it is frequently desirable to formulate the composition to contain a dye to allow workers handling the composition to distinguish between the additive composition and other petroleum products. It has been found that blue dye can be used to distinguish the additive composition where it is desired to do so.

The composition of the present invention is somewhat sensitive to variations in the amount of the various components employed. In general, the mineral seal oil generally constitutes from about 5% to about 15% by weight of the additive composition while the mineral spirits typically represents from about 40% to 60% by weight of the composition. The glycol ether should be employed in an amount within the range of about 20% to about 40% by weight of the composition; the total amount of the surfactant should range from about 2% to 15% of the composition.

In general, the additive composition of the present invention is prepared by conventional techniques. In general, it is preferred that the mineral spirits be blended with the mineral seal oil for about 0.5 to 20 minutes to ensure uniform blending of those two components. Thereafter, the glycol ether is added to the composition and then the surfactant is added, followed by blending of the surfactant. When a dye is used, the dye is used in an amount sufficient to provide a uniform color to the composition. Typically, a blue dye can be used in an amount within the range of about 0.1 to 5 ounces for every 300 gallons of the fuel additive composition.

The fuel additive composition of the present invention has been found to have particular utility in the treatment of liquid hydrocarbon fuels, and preferably gasoline (including both leaded and unleaded and gasoline containing denatured alcohol). Included also are kerosene-based fuels including kerosene itself and aviation fuels including jet fuels. In the treatment of such liquid hydrocarbon fuels, it is sufficient to blend the fuel additive with the fuel in an amount sufficient to reduce the pollution and emissions generated on combustion of the fuel to which the additive has been mixed. In general, the amount of additive employed ranges from about 0.005 to about 0.1 parts by volume of additive per part by volume of fuel. As those skilled in the art will appreciate, the amount of the fuel additive employed varies to some extent with the nature of the fuel with which it is blended. Tests have shown, however, that automobiles and buses using fuels with which the fuel additive has been mixed show a marked decrease in pollutants emitted during combustion.

Having described the basic concepts of the invention, reference is now made to the following examples which are provided by way of illustration and not by way of limitation of the practice of the invention in the formulation of the fuel additive composition and its use in the treatment of liquid hydrocarbon fuels.

EXAMPLE 1

A quantity of 12 parts by weight of mineral seal oil is blended with 48 parts by weight of mineral spirits, and the resulting mixture is blended for about 5 minutes to ensure a uniform blend. Thereafter, 32 parts by weight of ethylene glycol butyl ether is added to the blend with further stirring.

finally, 7 parts by weight of TERGITOL NP-9 is added and the entire mixture is blended for 10 minutes at ambient temperatures. Thus, the fuel additive has the following composition:

| | |
|---|---|
| Mineral Seal Oil | 12% by weight |
| Mineral Spirits | 48% by weight |
| Ethylene Glycol Butyl Ether | 32% by weight |
| TERGITOL NP-9 | 7% by weight |

The foregoing composition was tested with unleaded gasoline and was found to dramatically decrease pollutants emitted during combustion.

EXAMPLE 2

Using the procedure described in Example 1, the following composition was then prepared:

| | |
|---|---|
| Mineral Seal Oil | 10% by weight |
| Mineral Spirits | 50% by weiqht |
| Ethylene Glycol Butyl Ether | 30% by weight |
| TERGITOL NP-4 | 5% by weight |
| TERGITOL NP-9 | 5% by weight |

After the composition is prepared, a blue dye is added. When blended with gasoline, the fuel additive composition of the present invention is found to dramatically decrease pollutants emitted, even when tested in poorly tuned automobiles.

It will be understood that various changes and modifications may be made in the details of procedure, formulation and use without departing from the spirit of the invention especially as defined in the following claims.

What is claimed:

1. A fuel additive composition for use in the treatment of liquid of hydrocarbon fuels comprising from about 5% to 15% by weight of mineral seal oil, from about 40% to 60% by weight mineral spirits, from about 20% to 40% by weight ethylene glycol monoalkyl ether and about 2% to 15% of at least one alkyl aromatic ethoxylated surfactant.

2. A composition as defined in claim 1 wherein the mineral seal oil is a petroleum distillate having a boiling point above 250° C.

3. A composition as defined in claim 1 wherein the mineral seal oil has a boiling point within the range of 270° C. to 370° C.

4. A composition as defined in claim 1 wherein the mineral spirits is a petroleum fraction having a boiling point within the range of about 150° C. to about 220° C.

5. A composition as defined in claim 1 wherein the ethylene glycol monoalkyl ether as the formulation:

$$HO—CH_2—CH_2—O—R_1$$

wherein $R_1$ is an alkyl group containing 3 to 6 carbon atoms.

6. A composition as defined in claim 1 wherein the alkyl aromatic ethoxylated surfactant has the structure:

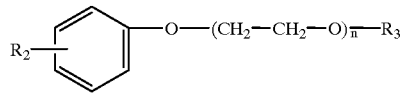

wherein $R_2$ is $C_6$ to $C_{12}$ alkyl, $R_3$ is hydrogen or $C_1$ to $C_3$ aklyl and n is an integer from 2 to 12.

7. A composition as defined in claim 6 which includes two surfactants, one surfactant being a surfactant in which $R_3$ is hydrogen and the other surfactant is a surfactant in which $R_3$ is $C_1$ to $C_3$ alkyl.

8. A composition as defined in claim 1 wherein the ethylene glycol monoalkyl ether is ethylene glycol mono butyl ether.

9. A composition as defined in claim 1 which includes two surfactants, one surfactant being nonyl phenol polyethoxylate and the other being nonyl phenol polyethylene glycol ether.

10. A method for the treatment of liquid hydrocarbon-containing fuels comprising adding to such fuels a fuel additive composition as defined by claim 1.

11. A method as defined in claim 10 wherein the liquid hydrocarbon is gasoline.

12. A fuel additive composition for use in internal combustion engines comprising a liquid hydrocarbon fuel and an additive composition, blended therewith, said additive composition containing about 5% to 15% of mineral seal oil, from about 40% to 60% by weight mineral spirits, from about 20% to 40% by weight ethylene glycol alkyl ether and about 2% to 15% of at least one alkyl aromatic ethoxylated surfactant.

13. A composition as defined in claim 12 wherein the liquid hydrocarbon fuel is selected from the group consisting of gasoline and kerosene-based fuels.

14. A composition as defined in claim 12 wherein the ethylene glycol alkyl ether has the formulation:

$$HO—CH_2—CH_2—O—R_1$$

wherein $R_1$ is an alkyl group containing 3 to 6 carbon atoms.

15. A composition as defined in claim 12 wherein the alkyl aromatic ethoxylated surfactant has the structure:

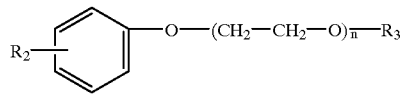

wherein $R_2$ is $C_6$ to $C_{12}$ alkyl, $R_3$ is hydrogen or $C_1$ to $C_3$ aklyl and n is an integer from 2 to 12.

16. A composition as defined in claim 12 which includes two surfactants, one surfactant being a surfactant in which $R_3$ is hydrogen and the other surfactant is a surfactant in which $R_3$ is $C_1$ to $C_3$ alkyl.

17. A composition as defined in claim 12 wherein the ethylene glycol alkyl ether is ethylene glycol mono butyl ether.

18. A composition as defined in claim 12 which includes two surfactants, one surfactant being nonyl phenol polyethoxylate and the other being nonyl phenol polyethylene glycol ether.

* * * * *